United States Patent [19]

Munach et al.

[11] Patent Number: 4,953,475

[45] Date of Patent: Sep. 4, 1990

[54] SAFETY-ARMING SYSTEM FOR LAUNCHED PROJECTILES

[75] Inventors: Arnold S. Munach, Rockville; John Q. Nguyen, Silver Spring, both of Md.

[73] Assignee: The United States of America as represented by the Secretary of the Navy, Washington, D.C.

[21] Appl. No.: 447,329

[22] Filed: Dec. 7, 1989

[51] Int. Cl.[5] ..... F42B 15/32

[52] U.S. Cl. ..... 102/229; 102/228; 102/256; 102/262

[58] Field of Search ..... 102/229, 228, 262, 263, 102/251, 254, 255, 256

[56] References Cited

U.S. PATENT DOCUMENTS

| | | | |
|---|---|---|---|
| H492 | 7/1988 | Kong et al. | 102/229 |
| 3,724,385 | 4/1973 | Beatty et al. | 102/229 |
| 3,927,617 | 12/1975 | Hoelzen et al. | 102/228 |
| 3,968,751 | 7/1976 | Palifka | 102/228 |
| 4,023,498 | 5/1977 | Harris | 102/228 |
| 4,216,723 | 8/1980 | Giladett | 102/229 |
| 4,380,197 | 4/1983 | Eaton | 102/229 |
| 4,407,201 | 10/1983 | Jensen | 102/256 |
| 4,815,381 | 3/1989 | Bullard | 102/262 |
| 4,848,235 | 7/1989 | Postler et al. | 102/256 |

*Primary Examiner*—David H. Brown

*Attorney, Agent, or Firm*—Kenneth E. Walden; Jacob Shuster

[57] ABSTRACT

Arming of a detonator carried within a tube-launched projectile is delayed in accordance with an operational program of a safety-arming system initiated by simultaneous and independent detection of projectile propulsion involving pressure generated by an activated projectile propelling motor and inertial forces accompanying acceleration of the projectile during launch. Operating energy necessary to complete the operational program, terminated after the projectile is launched, is stored within the projectile during launch in response to said generation of pressure by the activated propelling motor.

33 Claims, 8 Drawing Sheets

SAFETY-ARMING SYSTEM FOR LAUNCHED PROJECTILES

BACKGROUND OF THE INVENTION

This invention relates generally to the arming of projectile carried detonators, including but not necessarily limited to detonators utilized to deploy a projectile retarding parachute after launching of the projectile.

Non-spinning projectile ammunition from which a parachute retarder is deployed during flight in order to establish a desired range to the point of impact, employ an explosive train type of detonator. In certain projectiles there is a fuzing system through which firing of the projectile warhead at target impact is achieved under control of an associated safety-arming device. An auxiliary safety-arming device is associated with such projectile in order to arm the detonator explosive train through which the retarder parachute is deployed at a programmed time during flight of the projectile. The auxiliary safety-arming device receives electrical energy from the warhead fuzing system at the appropriate time to effect such retarder deployment. Hopefully, premature ignition of the detonator is thereby avoided as well as the consequences thereof, which include generation of heat and shock waves and premature expulsion of the parachute which is necessarily violent and therefore extremely hazardous to personnel and equipment because of high velocity explosive fragmentation and the momentum of massive components.

Presently available safety-arming systems for projectile detonators of the aforementioned type are mechanically complex and do not meet all of the explosive design safety requirements normally imposed on ordnance fuzes and safety-arming devices. Some of such requirements include (1) physical interruption in the detonator explosive train for deploying the retarder parachute prior to launch of the projectile, (2) preventing retarder deployment until the projectile is at an acceptable distance from its launch tube, (3) arming the detonator in response to propulsion of the projectile only by sensing of two different and independent conditions reflecting such propulsion, (4) avoiding the use of any pre-stored energy through which premature arming of the detonator may be effected and (5) providing facilities for indicating the safe and armed condition of the safety-arming device at all times prior to installation of the projectile in its launch tube.

It is therefore an important object of the present invention to provide a safety-arming system for a detonator carried by a projectile, meeting all of the aforementioned safety criteria requirements.

It is a further object of the present invention to provide a safety-arming system for the projectile detonator of a launched projectile which is less mechanically complex and more cost effective without any compromise of the safety requirements aforementioned.

SUMMARY OF THE INVENTION

The present invention is applicable by way of example to a tube launched projectile having a main fuze system for explosively igniting the projectile warhead on impact, a propulsion motor for accelerating the projectile through its launch tube and a firing circuit energized by the main fuze system for programmed ignition of a detonator through which a flight retarding parachute is expelled from the projectile. Such a projectile is also provided with a removably installed safety-arming unit of novel arrangement in accordance with the present invention. Such safety-arming unit houses two different detector devices through which propulsion of the projectile through its launching tube is sensed in accordance with two different and independent conditions. One of the detectors responds to pressure generated by the propelling motor when activated to displace a piston which thereby loads and stores operating energy in a piston spring. Initial displacement of the piston by such motor pressure ruptures a shear wire normally holding the piston in an inactive position. The other detector senses acceleration of the projectile by travel of a setback weight component relative to the projectile in which it is carried. Gaps in an electrical ignition path and in an explosive propagation path of the detonator are physically established and maintained by means of a slider component of an interruption control assembly.

Arming of the the slider is influenced by environmental lock means which include another shear wire normally holding the slider in a safe condition and an interlocking ball. The shear wire is ruptured by continued displacement of the piston by motor pressure. Travel of the setback component occurs against a spring bias in a direction determined by orientation of the unit housing in the projectile, transverse to the direction of slider displacement to an armed position removing the gaps in the ignition and explosive propagation paths under the operating energy from the loaded piston spring.

The interlocking ball in an active position is engaged between the setback and slider components of the interruption control assembly to prevent displacement of the slider to the armed position. The interlocking ball is retracted from its active position to an inactive position by capture within a tapered bore formed in the setback component when the setback component reaches the end of its travel in response to projectile acceleration. Upon return travel of the setback component under its spring bias, when projectile acceleration decrease below its spring bias level during approach to the exit end of the launching tube, a recess in the setback component is aligned with the slider component to enable its displacement to the armed poisiton under the impetus of the operating energy stored by the loaded piston spring during projectile launch. The fully armed condition of the safety unit is thereby delayed until the projectile has exited the launch tube.

Prior to installation of the safety-arming unit in a projectile, the presence of the shear wires aforementioned may be verified by observation of their ends through openings in the unit housing while the interlocking ball may be viewed in its active position between the slider and setback components in their safe positions through a window in the unit housing through which the engaged end portion of the slider may also be viewed. The safe or armed condition of the safety arming unit may thereby be visually verified prior to its installation in the projectile.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
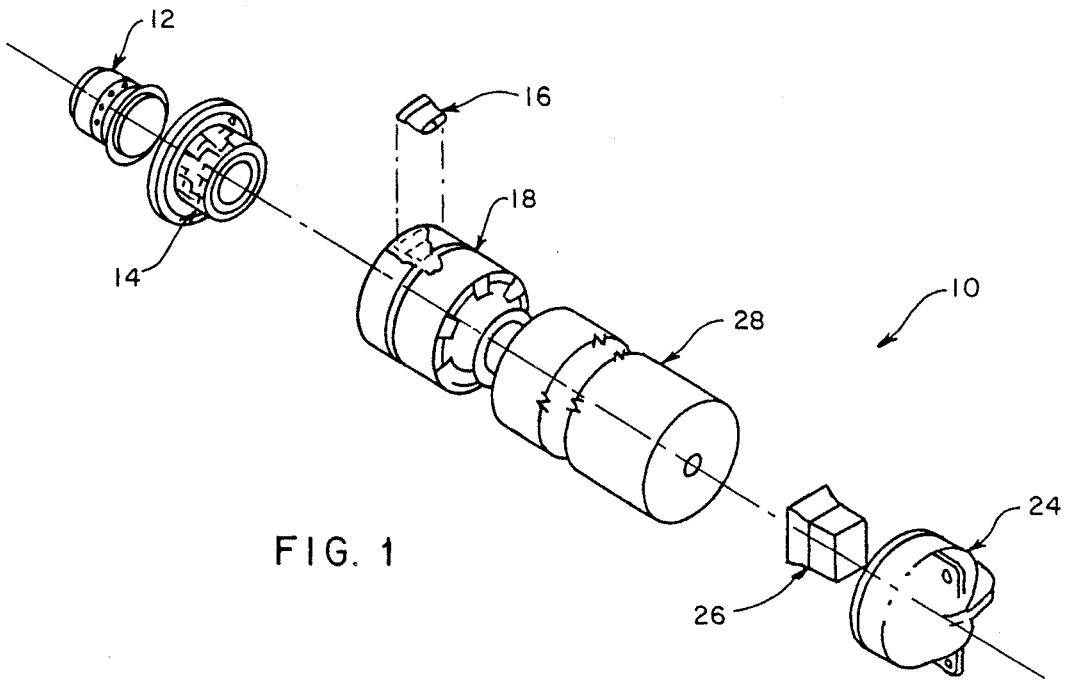
FIG. 1 is an exploded perspective view of a disassembled projectile with which the present invention is associated in accordance with one embodiment.

Referring now to the drawings in detail, FIG. 1 is an exploded view of a typical projectile, generally referred to by reference numeral 10, with which the present invention may be associated. The projectile includes at one axial end a propelling motor 12, and a parachute type of retarder assembly 14 that is explosively deployed in response to a signal from a safety-arming unit generally referred to by reference numeral 16, adapted to be installed within a tail section fin stabilizer portion 18 of the projectile. A nose cap 24 at the end of the projectile 10 protectively encloses a main fuze section 26 of the projectile connected to a warhead 28 within which the explosive payload is housed between the nose cap 24 and the tail section stabilizer 18.

As is already known in the art, the aforementioned type of projectile 10 is launched into the air from a launch tube by activating the propelling motor 12. The nose cap 24 forms a sealing interface with the projectile warhead 28 during launch in protective relation to the main fuze section 26. The safety-arming unit 16 is removably assembled within the tail section stabilizer 18, as more clearly seen in FIG. 2, and is electrically connected through cable 30 to a firing circuit associated with the main fuze section 26 of the projectile as described in connection with FIG. 1.

Figure 3:
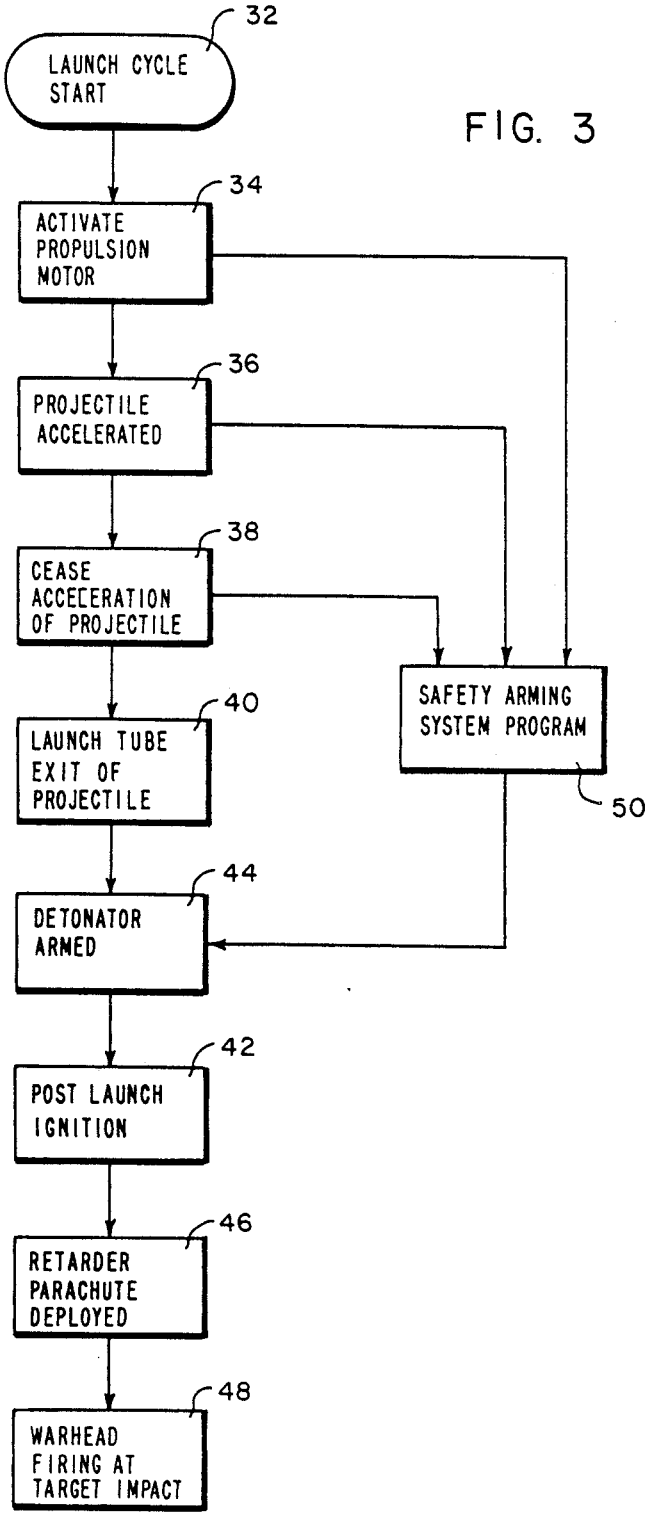
FIG. 3 is a program flow chart depicting the launching and firing program for the projectile and associated safety arming unit illustrated in FIGS. 1 and 2.

As depicted in FIG. 3, the projectile launching program is initiated by cycle start 32, to activate the propulsion motor 12 as indicated by reference numeral 34. As a result of such activation of the propulsion motor, the projectile is accelerated through the launch tube as indicated by reference numeral 36 in FIG. 3. As the projectile approaches the exit end of the launch tube, its acceleration ceases as indicated by reference numeral 38 after which the projectile continues travel upon exiting of the launch tube as indicated at 40. During post-launch travel of the projectile, retarder detonator is armed as indicated at 44 in FIG. 3 and programmed delivery of electrical energy by the main fuze occurs as indicated by reference numeral 42 in order to deploy the retarder parachute assembly 14 as indicated by reference numeral 46 in FIG. 3. By virtue of such deployment of the retarder parachute, continued travel of the projectile is limited to the desired range at the end of which target impact occurs to trigger firing of the projectile warhead, as indicated by reference numeral 48 of FIG. 3, terminating the program.

In order to ensure a proper and safe sequence of events in the program described in connection with FIG. 3, the safety-arming unit 16 hereinbefore described in connection with FIGS. 1 and 2 undergoes a safety arming program 50 as depicted in FIG. 3. The system program 50 takes into account sensing of the motor activation event 34 and the projectile acceleration events 36 and 38 as diagrammed in FIG. 3, in order to effect staged arming of the projectile detonator only during launch and to delay completed arming of the detonator to some time after projectile launch for deployment of the parachute retarder at some safe distance from the launch tube.

Figure 4:
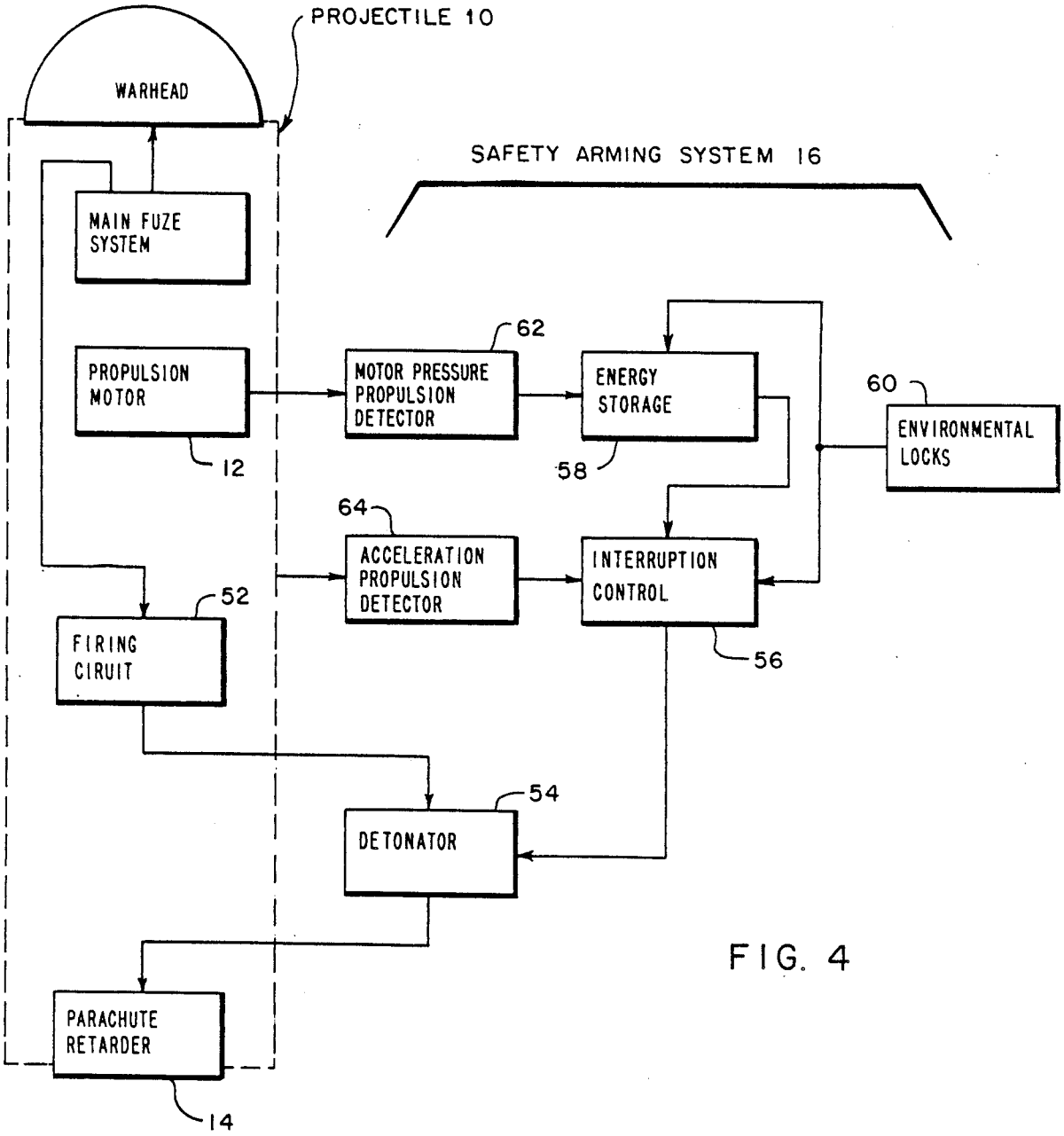
FIG. 4 is a functional block diagram illustrating the projectile and safety arming system associated therewith, in accordance with one embodiment of the present invention.

As diagrammed in FIG. 4, the projectile 10 is operatively connected to the safety-arming system of unit 16 through its propulsion motor 12, its firing circuit 52 and its parachute retarder assembly 14. A detonator component 54 associated with the safety-arming unit 16 operatively interconnects the firing circuit 52 with the parachute retarder assembly 14 pursuant to an operational procedure of the system program 50. Toward that end, an interruption control component 56 associated with the safety-arming system is operative through the detonator 54 to establish and maintain an interrupted electrical path from the firing circuit 52 through the detonator 54 as well as a physical interruption in the explosive path to the retarder 14 to prevent premature detonation and expulsion of the retarder parachute. Operation of the interruption control 56 is effected by release of operating energy that is stored within the safety-arming unit by means of an energy storage component 58, within which the storing of operating energy occurs only during launching of the projectile to thereby avoid any pre-storage of operating energy. Also, prior to launch of the projectile the energy storage component 58 and interruption control component 56 are maintained in safe conditions by an environmental lock arrangement generally referred to by reference 60 in FIG. 4.

Operation of the safety-arming system is furthermore dependent upon two different and independent operating conditions, unique to the projectile launching environment, respectively sensed by a motor pressure propulsion detector 62 and an acceleration propulsion detector 64 as diagrammed in FIG. 4. By means of the propulsion detector 62, the storage of operating energy is initiated in response to activation of the propulsion motor 12, as reflected by the generation of motor pressure. The ensuing acceleration of the projectile through the launch tube is sensed by detector 64 for staged continuation of the operational sequence in the interruption control component 56. After cessation of projectile acceleration, as also sensed by detector 64, the operational sequence of interruption control 56 is completed to attain a fully armed condition. Such completion of the operational sequence occurs after projectile exit from the launch tube, at which point the control 56 effects an electrical connection of the firing circuit through the detonator and removes the interruption in the explosive train so that the detonator is then enabled in order to effect timely programmed expulsion of the retarding parachute from the retarder section 14 during post-launch travel of the projectile.

Figure 2:
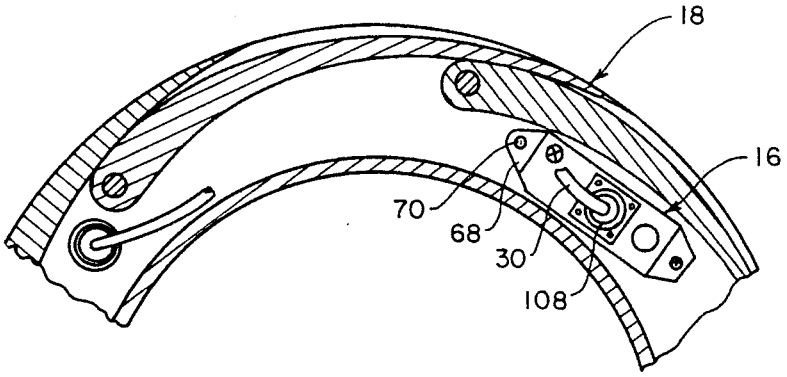
FIG. 2 is an enlarged partial sectional view of a portion of the projectile shown in FIG. 1.
Figure 5:
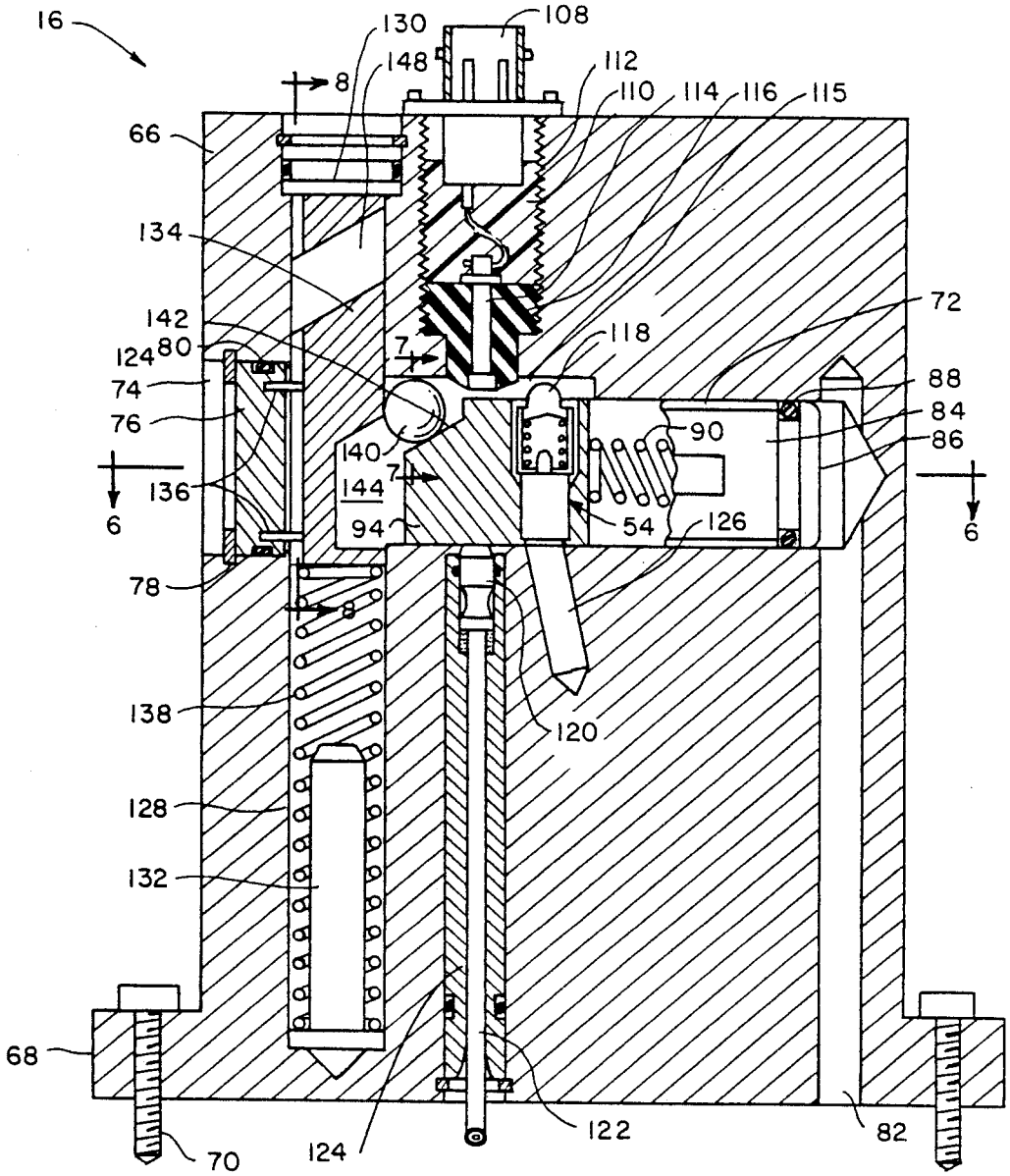
FIG. 5 is a side section view through the safety-arming unit associated with the projectile installation shown in FIGS. 1 and 2, in an initial safe condition.
Figure 6:
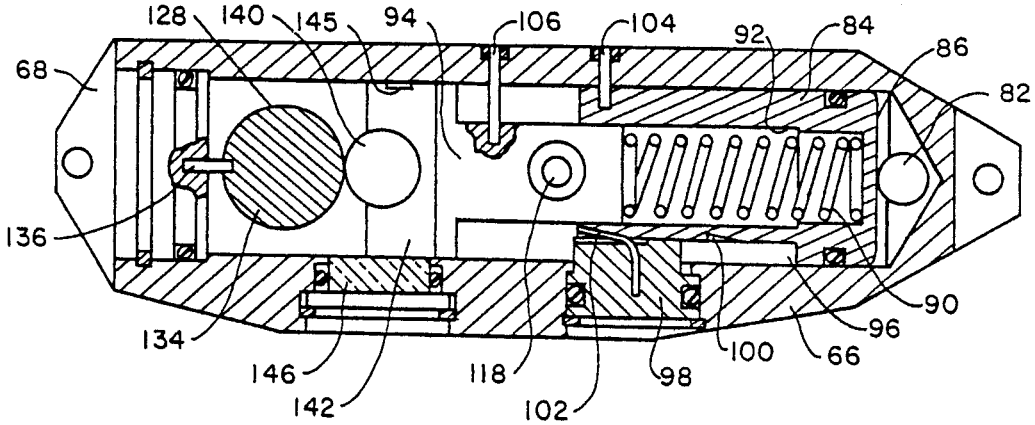
FIG. 6 is a transverse section view taken substantially through a plane indicated by section line 6—6 in FIG. 5, corresponding to an initial safe condition of the safety arming unit.

Referring now to FIGS. 5 and 6 in particular, all components of the safety-arming unit 16 as hereinbefore referred to, are sealed within an enclosing housing generally referred to by reference numeral 66, said housing having mounting flanges 68 through which the unit is attached by fasteners 70 to the tail section stabilizer section 18 of the projectile as aforementioned in connection with FIG. 2. The housing body is formed with an elongated cylindrical bore 72 having an enlarged open end 74 within which a guide block 76 is retained by an annular retainer ring 78. An o-ring seal 80 positioned within an annular groove in the guide block 76, seals the enlarged opened end portion 74 of the bore 72, the opposite end of which is in communication with a pressure port passage 82 in fluid communication with the propelling motor 12. The pressure port passage 82 within the housing 66 of unit 16 accordingly forms part of the motor pressure propulsion detector 62 aforementioned in connection with FIG. 4, together with a piston 84 slidably disposed within the bore 72 and having an end face 86 to which fluid pressure force is applied. An o-ring seal 88 mounted on the piston 84 adjacent its end face 86 provides fluid sealing for the bore 72 adjacent the motor pressure sensing end thereof opposite the open enlarged end portion 74.

The energy storage 58 hereinbefore referred to in connection with FIG. 4 is constituted by a coil spring 90 seated within an internal cylindrical cavity 92 of the piston 84 in an uncompressed state while the piston is in its initial position as shown in FIG. 6. One axial end of the coil spring 90 engages the piston 84 within cavity 92 with its opposite axial end abutting a slider 94 forming part of the interruption control 56 diagrammed in FIG. 4. The slider 94 is also slidably disposed within the bore 72 for displacement from it safe position as shown in FIG. 6 under the bias of coil spring 90 after it is fully loaded by the piston 84 to store operating energy therein, as will be explained in detail hereinafter.

With continued reference to FIG. 6, the piston 84 is provided with a guide slot 96 within which a guide block 98 is slidably received in order to guide axial movement of the piston through the bore 72 in response to pressure applied to its end face 86 by pressure from the propelling motor. A locking notch 100, formed in the piston 84 and exposed through the guide slot 96, is adapted to be engaged by a leaf spring stop 102 anchored to and projecting from the guide block 98 for reception within the notch 100 to lock the piston in a spring loading position at the end of its travel stroke under pressure from the propelling motor. Compressive loading of the spring 90 occurs in response to such travel of the piston 84 as long as the slider 94 slidably received within a slotted portion 92 of the piston, is held in its safe position as shown in FIG. 6. The piston 84 and the slider 94 are respectively held in the initial and safe positions, as shown, by a pair of shear wires 104 and 106 anchored to the housing 66. The shear wires thus extend from the housing transverse to the direction of movement of the piston and slider and are received within openings formed in the piston and slider, in alignment with bores formed in the housing 66 as shown. Accordingly, accidental or unintended displacement of the piston and slider relative to the housing 66 will be prevented. However, during displacement of the piston in accordance with the operational procedure of the safety-arming system, by forces exceeding certain predetermined design magnitudes, the wire 104 and the environmental lock wire 106 are sequentially sheared by the displacement of piston 84 and the slider 94.

The electrical ignition path to the detonator 54 from the firing circuit includes therein an electrical connector 108 fixedly mounted on the housing 66 as shown in FIGS. 2 and 5. The connector 108 is adapted to be connected by cable 30 to the external firing circuit 52 and extends into an epoxy body 110 disposed within an internally threaded bore 112 formed in the housing. The epoxy body 110 protectively embeds the electrical connection between the connector 108 and a contact element 114 mounted by an insulator body 116 threadedly secured within the bore 112 of the housing. The inner end of the contact element 114 is thereby exposed to the bore 72 through an axially extending slot 115 into which the contact element projects as shown in FIG. 5. The detonator 54, carried by the slider 94, includes an electrical shorting switch 118 disposed in axially spaced relation to the contact element 114 in the safe position of the slider 94 as shown in FIG. 5. The spring loaded switch 118 in such safe position of the slider 94 establishes an electric detonator short corresponding to a safe condition of the safety-arming unit. Also, by virtue of the axially spaced relationship of the switch 118 to the contact element 114, an electric firing circuit gap is established in such safe condition of the safety-arming unit. The electric, short so maintained by switch 118 prevents premature detonator firing due to electrostatic discharge.

Also associated with the detonator 54 is a lead charge 120 connected to a flexible detonating cord 122 extending through a support tube 124 occupying a bore in the housing extending at right angles to the piston and slider bore 72. The detonating cord 122 is in axial alignment with the fixed contact element 114 from which it is physically separated by the bore and the slider in its safe position, and is connected to the parachute retarder assembly 14. It will therefore be apparent that when the slider is axially displaced to an arming position, switch 118 is actuated by engagement with the contact element 114 to complete the electrical ignition path between the contact element 114 and the detonator and at the same time remove the electrical short in order to enable the detonator so that it may be subsequently fired to effect deployment of the retarding parachute. A firing relief cavity 126 is formed in the housing in communication with the slider bore 72 adjacent to the switch 118 and lead charge 120 as shown in FIG. 5 to receive fragments and permit expansion therein of hot gases in the event the detonator prematurely fires.

With continued reference to FIG. 5, the housing 66 is formed with an elongated cylindrical bore 128 extending in intersecting right angular relation to the piston and slider bore 72. The bore 128 is sealingly closed at one end by a sealing stop 130 while an elongated stop element 132 extends with radial clearance through the bore 128 from its opposite end within the housing. The stops 130 and 132 accordingly define the axial stroke limits of a cylindrical setback weight element 134 forming part of the interruption control 56 aforementioned. The setback element 134 is guided for axial travel between its limit positions by a pair of guide pins 136 projecting from the guide block 76, closing the open end of the bore 72 as aforementioned. A coil spring 138 seated within the setback bore 128 about the elongated stop element 132, biases the setback element 134 to one axial limit position as shown in FIG. 5, constituting its initial static position. The orientation of the setback bore 128 relative to the projectile 10 within which the unit housing 66 is installed, is such that inertia force acting on the setback mass during acceleration of the projectile through the launching tube following activation of the propelling motor causes it to be displaced against the bias of spring 138 relative to the projectile body. Acceleration responsive travel of the setback element relative to the projectile body will thus occur in one axial direction transverse to the axis of the piston and slider bore 72 constituting the path of displacement of the piston and slider. The force characteristics of spring 138 and the stroke of setback element 134, together determine the energy threshold that must be exceeded to achieve full travel of the setback element. The threshold is such that credible pre-launch handling will not cause full travel of the setback element.

Figure 7:
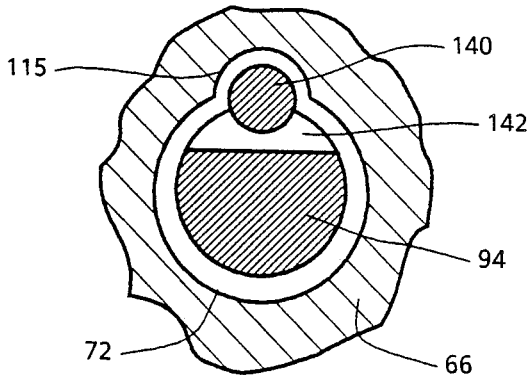
FIG. 7 is an enlarged partial section view taken substantially through a plane indicated by section line 7—7 in FIG. 5.

The interruption control 56 as hereinbefore referred to in connection with FIG. 4 also includes an interlocking ball 140, shown in FIG. 5 in an active position engaging a beveled end surface 142 of the slider 94 and the external cylindrical surface of the setback element 134 on one axial side of a recess or notch 144 formed in the setback element as shown. The interlocking ball 140 in its active position is furthermore disposed within slot 115 as more clearly seen in FIG. 7. In such active position of the interlocking ball 140, axial displacement of the slider 94 to the arming position aforementioned is prevented. The interlocking ball 140 together with shear wire 106 thus block unintended travel of slider 94 to its arming position under the influence of environmental conditions and therefore constitute the environmental locks 60 diagrammed in FIG. 4.

In the active positions as shown in FIGS. 5 and 6, the interlocking ball 140 is aligned with a window 146 sealingly mounted in one side of the housing 66 opposite a side having a color-coded marking 145 as shown in FIG. 6, visually blocked by ball 140. The interlocking ball 140 will be visually exposed through the window 146 so as to indicate the safe condition of the unit 16 prior to its installation into the projectile. In the absence of ball 140, marking 145 will be visible through window 146 to indicate the missing ball. The presence of the shear wires 104 and 106 may also be verified since their outer ends will be exposed through the sealed bore openings in the housing from which such shear wires are visible as shown in FIG. 6.

Figure 5A:
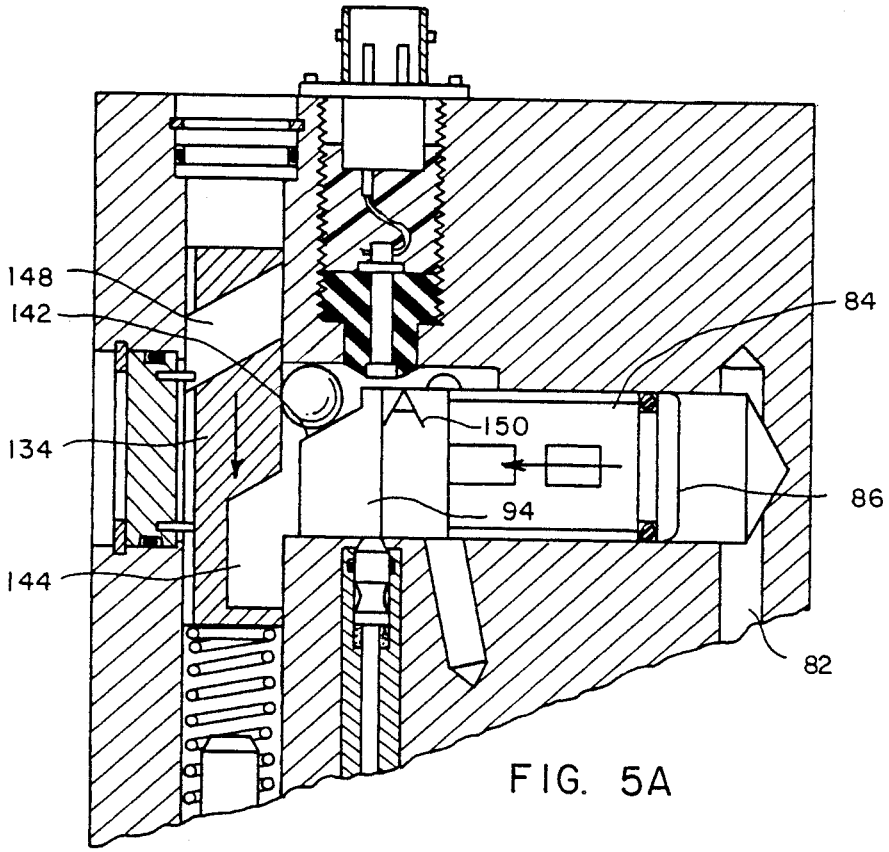
FIGS. 5A, 5B, 5C and 5D are side section views similar to that of FIG. 5 showing the safety-arming unit in different operating conditions.

When the projectile 10 is launched, pressurized fluid produced by its propelling motor is fed into the unit 16 through port passage 82 so as to act on the end face of the piston 84 which is thereby displaced to rupture shear wire 104 and compress the piston spring 90 against the slider 94 held in its safe position by the interlocking ball 140. At the same time, inertia forces produced by acceleration of the projectile cause the setback element 134 to be translated against the bias of its pre-loaded spring 138 causing compression thereof in accordance with a predetermined acceleration-time profile during projectile launch. Initial displacement of the piston 84 and setback element 134 from their static positions is shown in FIGS. 5A and 6A. Despite such initial displacements of the piston 84 and setback element 134, the slider 94 is held in its safe position by the interlocking ball 140 so as to maintain the aforementioned interruption of the electric ignition and explosive propagation paths. As the piston 84 approaches the end of its travel stroke, it shears wire 106 and becomes locked in a spring loading position as shown in FIGS. 5B and 6B, with piston spring 90 fully compressed or loaded so as to store therein the requisite operating energy for subsequent advancement of the slider 94 to its arming position.

Figure 5B:
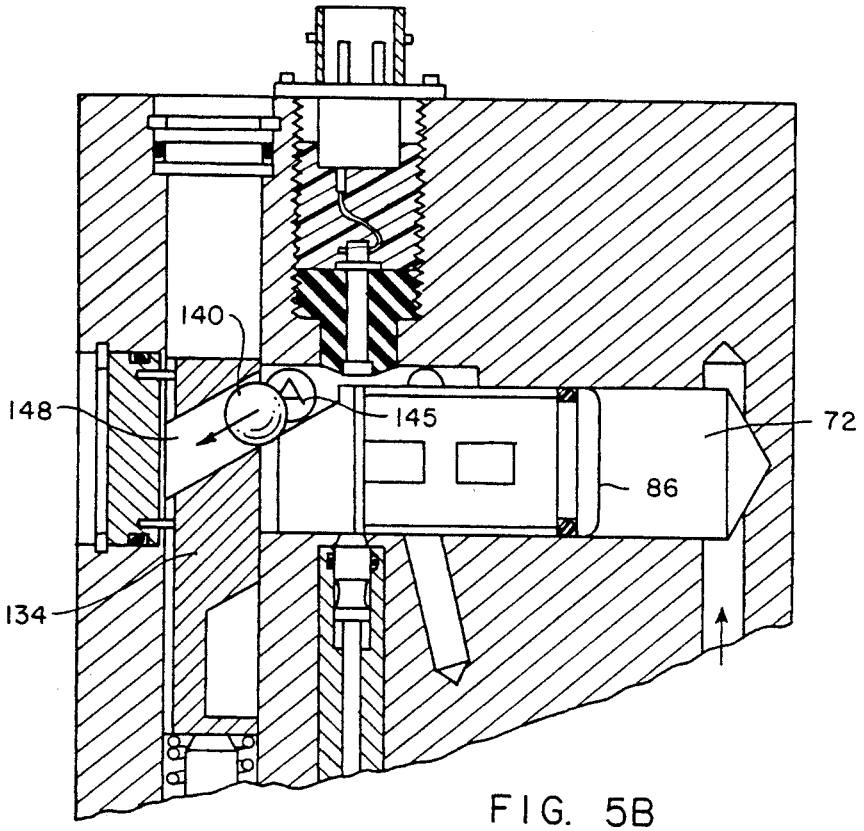
Figure 5C:
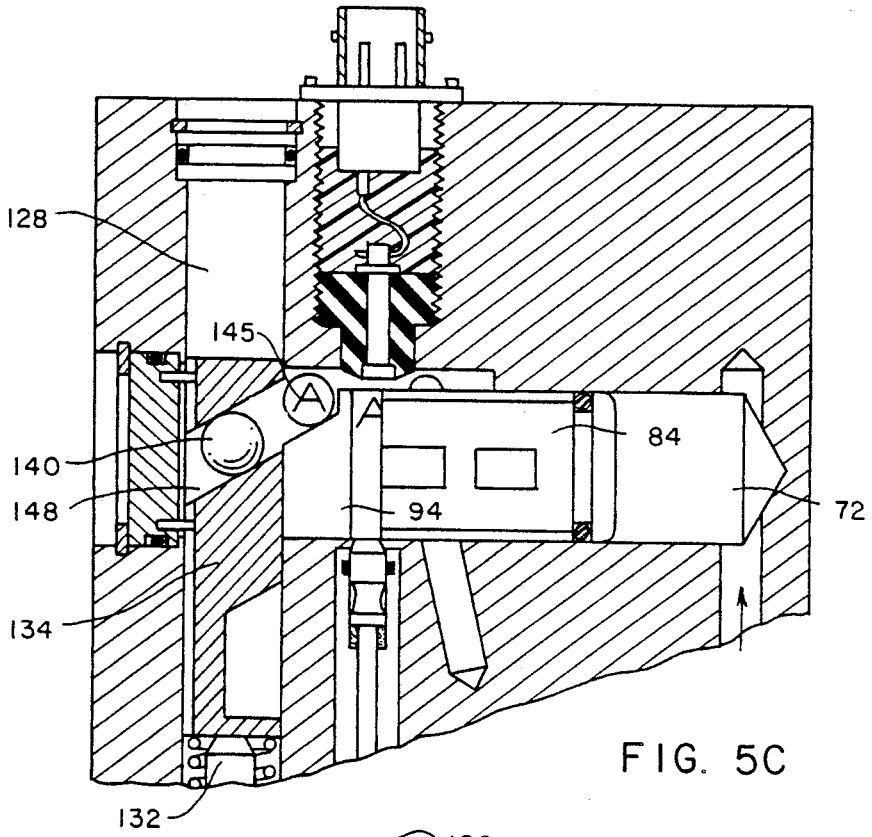
Figure 6A:
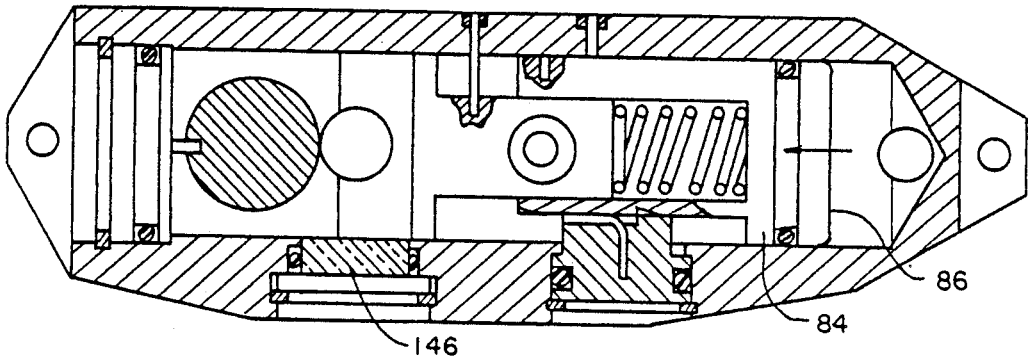
FIG. 6A and 6B are transverse section views similar to that of FIG. 6 showing the safety-arming unit in different operating conditions respectively corresponding to that of FIGS. 5A and 5B.
Figure 6B:
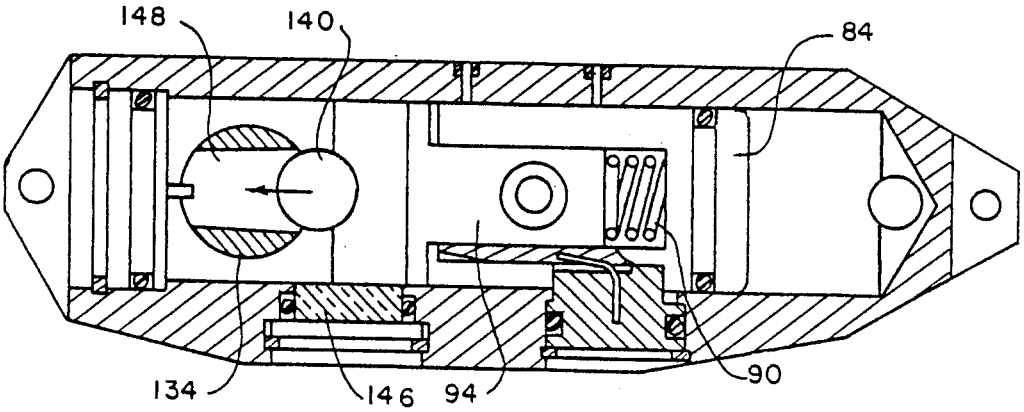

As travel of the acceleration responsive setback element 134 approaches completion, one end of a tapered bore 148 formed in the setback element becomes aligned with the interlocking ball 140 as shown in FIGS. 5B and 6B. Accordingly, the interlocking ball 140 under inertia forces arising during the aforesaid acceleration of the projectile, rolls along face 142 of slider 94 guided by slot 115 and enters the bore 148 to become wedged or captured in the setback element 134. The interlocking ball element 140 is retained by bore 148 in its inactive position within the setback element out of engagement with the slider 94 for the remainder of the operational cycle of the system program 50. However, the slider 94 cannot be fully translated to its arming position under the bias of loaded piston spring 90 in the limit position of the setback element 134 as shown in FIG. 5C because of slider contact with the cylindrical surface of the setback element between the slider receiver notch 144 and the ball capturing bore 148.

Figure 5D:
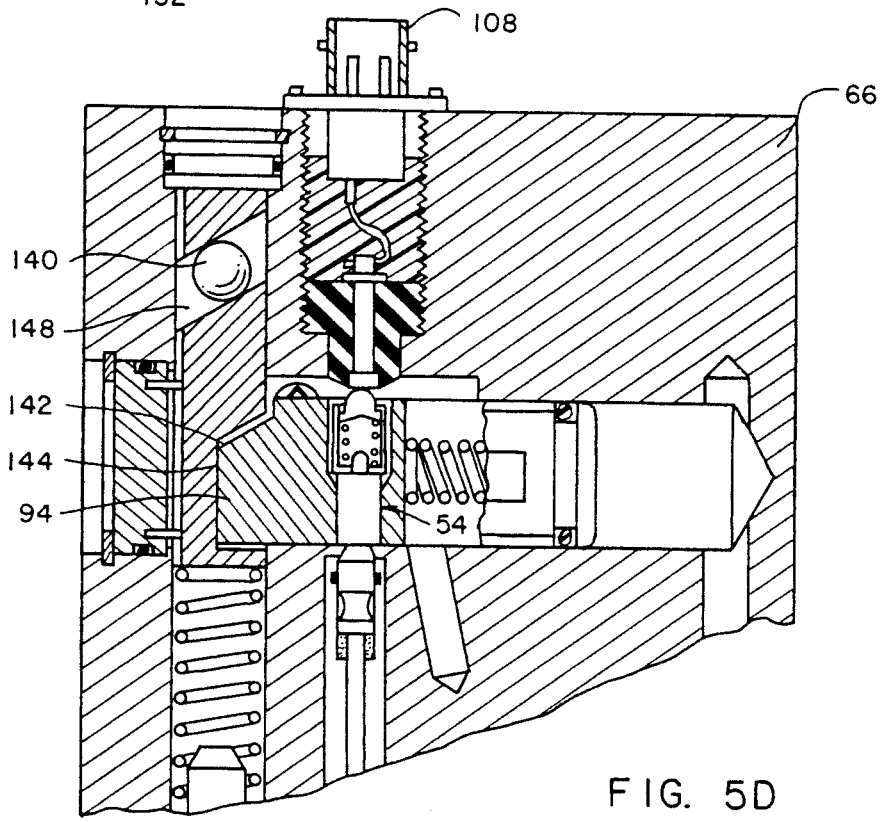
Figure 5E:
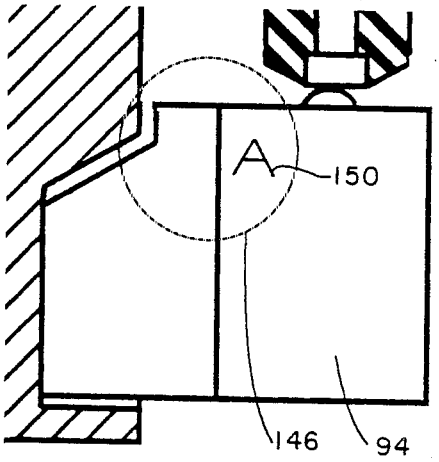
FIG. 5E is an enlarged partial side view, corresponding to FIG. 5D, showing the window in dotted line to illustrate its relationship to internal parts in the associated operating condition of the safety-arming unit.

When acceleration of the projectile ceases as the projectile approaches the exit end of its launching tube, the compressed spring 138, as shown in FIG. 5C, biases the setback element in a return direction to the initial position as shown in FIG. 5D with the interlocking ball 140 captured therewithin in its inactive position. The slider receiving notch 144 will then be aligned with the adjacent end of the slider 94 so as to enable displacement of the slider to its arming position under the bias of the energy storing piston spring 90 as the stored operating energy is released. In such arming position of the slider, another color coded marking 150 on the slider itself will be visibly exposed through the window 146, shown in FIG. 5E, so as to indicate the armed condition of the unit 16. In such armed condition, the switch 118 will be depressed or actuated by virtue of its engagement with the contact 114 so as to remove the electrical short aforementioned, establish the electrical ignition path through the detonator and establish the aligned explosive train between detonator 54 and lead charge 120 in order to enable ignition of the detonator for deployment of the retarding parachute.

Figure 8:
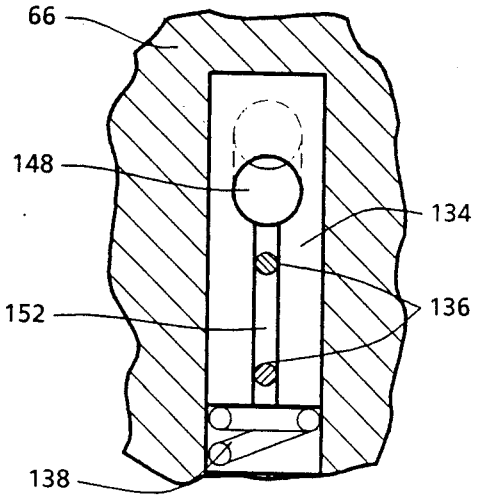
FIG. 8 is a partial section view taken substantially through a plane indicated by section line 8—8 in FIG. 5.

In the embodiment illustrated in FIGS. 5 and 6, a pair of guide pins 136 are slidably received within a guide slot 152 formed in the setback element 134 as more clearly seen in FIG. 8 in order to prevent angular displacement of element 34 about its travel axis. In such arrangement, travel of the setback element in without angular movement occurs response to development and cessation of acceleration inertia forces. Such travel will be dependent upon the mass of the setback element 134 and the characteristics of the pre-loaded spring 138 acting on one end thereof as hereinbefore described. As aforementioned, return travel of the setback element does not begin until the projectile approaches the exit end of its launch tube. Because of the time required for return travel of the setback element and subsequent travel of slider 94 into notch 144 (when aligned therewith at the end of setback return), arming of the slider carried detonator will not occur until after the projectile has exited the launch tube.

Figure 9:
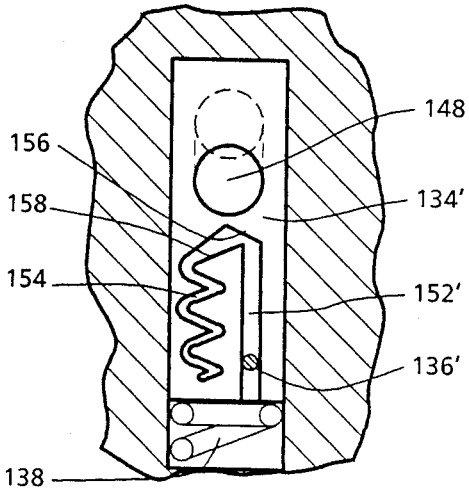
FIG. 9 is a partial section view similar to that of FIG. 8 showing a modification in accordance with another embodiment of the present invention.

It may be desirable in certain installations to dampen or slow return travel of the setback element in order to increase return travel time and thereby obtain a greater separation time and distance between the exit end of the launch tube and the point at which the projectile is fully armed. Such desired dampening of return travel is achieved in accordance with an embodiment illustrated in FIG. 9. As shown in FIG. 9, a single guide pin 136', corresponding to the pair of guide pins 136 in FIG. 8, is received within a straight slot portion 152' of a modified setback element 134' during acceleration induced travel thereof. As the setback element 134' approaches the end of its acceleration induced travel stroke against the bias of spring 138, its guide pin 136' is decelerated by engagement with cam surface 156. In response to ensuing return travel of setback element 134', pin 136' strikes cam surface 158 which is angled toward a zig-zag return travel slot portion 154 to ensure that pin 136' enters such slot portion during return travel of the setback element. Such return travel is dampened by the angular oscillation of the setback element 134' about its axial travel axis imposed by the zig-zag slot portion 154 during completion of the operational cycle.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents to, falling within the scope of the invention.

What is claimed is:

1. In combination with a projectile launched by activation of a propelling motor, said projectile having a firing circuit, a detonator and a safety arming system including interruption control means operatively interconnected between the firing circuit and the detonator for maintaining the detonator disabled and means applying operating energy to the interruption control means for transfer to the detonator, the improvement residing in means responsive to said activation of the propelling motor for storing the operating energy within the projectile and means responsive to acceleration of the projectile for delaying said transfer of the operating energy from the interruption control means during launching of the projectile to enable the detonator after said launching of the projectile.

2. The improvement as defined in claim 1 wherein said means for storing includes a piston, spring means for resisting displacement of the piston and fluid pressure passage means operatively connecting the propelling motor to the piston for effecting said displacement thereof to a spring loading position during which the operating energy is stored in the spring means.

3. The improvement as defined in claim 2 wherein said energy applying means includes a slider in abutment with the spring means and said delaying means include interlocking means engageable with the slider and the acceleration responsive means for preventing displacement of the slider by said spring means in the spring loading position of the piston and means mounted on the slider for effecting said enabling of the detonator in response to said displacement of the slider by said spring means to an arming position.

4. The improvement as defined in claim 3 wherein said safety-arming system further includes a housing mounted in the projectile and having a window through which the interlocking means and the slider are visually exposed, alternatively.

5. The improvement as defined in claim 3 wherein said acceleration responsive means for delaying includes a setback element movable relative to the projectile in opposite directions, guide means mounting the setback element for travel in one of the opposite directions under forces exerted in response to said acceleration of the projectile, means responsive to said travel of the setback element in said one of the opposite directions for retracting the interlocking means from engagement with the slider and means responsive to return travel of the setback element in the other of the opposite directions while the interlocking means is retracted therein for enabling said displacement of the slider to the arming position.

6. The improvement as defined in claim 5 wherein said safety-arming system further includes a housing mounted in the projectile and having a window through which the interlocking means is visually exposed prior to said retraction thereof within the setback element.

7. The improvement as defined in claim 5 wherein said interlocking means is a spherical ball and said retracting means is a tapered hole formed in the setback element within which the ball is captured.

8. The improvement as defined in claim 5 wherein said means for enabling said displacement of the slider to the arming position is a slider receiving notch formed in the setback element.

9. The combination of claim 1 wherein said means for storing includes environmental lock means responsive to said activation of the propelling motor for limiting said storing of the operating energy and said enabling of the detonator in timed sequential relation to each other.

10. The improvement as defined in claim 9 wherein said means for storing further includes a piston engageable with the environmental lock means, spring means for storing the operating energy in response to displacement of the piston and fluid pressure passage means operatively connecting the propelling motor to the piston for effecting said displacement thereof to a spring loading position during which the operating energy is stored within the spring means.

11. The improvement as defined in claim 10 wherein said operating energy applying means includes a slider in abutment with the spring means and said means for delaying includes, interlocking means engageable with the slider for preventing displacement of the slider by said spring means in the spring loading position of the piston and means mounted on the slider for effecting said enabling of the detonator in response to said displacement of the slider to an arming position.

12. The improvement as defined in claim 11 wherein said slider mounted means is a shorting switch actuated in the arming position of the slider.

13. The improvement as defined in claim 12 wherein said means for delaying further includes a setback element movable relative to the projectile in opposite directions, guide means mounting the setback element for travel in one of the opposite directions under forces exerted in response to said acceleration of the projectile, means responsive to said travel of the setback element in said one of said opposite directions for retracting the interlocking means from engagement with the slider and means responsive to return travel of the setback element in the other of the opposite directions while the interlocking means is retracted for enabling said displacement of the slider to the arming position.

14. The improvement as defined in claim 13 including means for dampening said return travel of the setback element.

15. The improvement as defined in claim 14 wherein said safety-arming system further includes a housing mounted in the projectile and having a window through which the interlocking means is visually exposed prior to said retraction thereof within the setback element.

16. In a safety system carried by a projectile having a detonator and control means responsive to operating energy applied thereto enabling the detonator, means responsive to launching of the projectile for storing the operating energy therein and means operatively connected to the control means for delaying the application of the operating energy thereto from the storing means in response to acceleration of the projectile during said launching thereof.

17. The combination of claim 16 wherein said control means include means for detecting acceleration of the projectile, a slider in abutment with the operating energy storing means and said delaying means include interlocking means engageable with the slider and the acceleration detecting means for preventing displacement of the slider to an arming position by the operating energy.

18. The combination of claim 17 wherein said delaying means further includes a setback element movable relative to the projectile in opposite directions, guide means mounting the setback elements for travel in opposite directions under forces exerted thereon during said acceleration of the projectile and cessation of said acceleration, means responsive to said travel of the setback element in one of the opposite directions for retracting the interlocking means from engagement with the slider and means for enabling said displacement of the slider to the arming position in response to said travel of the setback element in the other of the opposite directions.

19. The combination of claim 18 wherein said means for retracting comprises a slider receiving notch formed in the setback element.

20. The combination of claim 18 wherein said interlocking means is a spherical ball and said retracting means is a tapered hole formed in the setback element within which the ball is captured.

21. The combination of claim 20 wherein said travel responsive means for retracting comprises a slider receiving notch formed in the setback element.

22. A safety system adapted to be installed in a projectile having a detonator to which an ignition path is established, said system including switch means for maintaining an interruption in said ignition path during launching of the projectile, means for storing operating energy during said launching of the projectile, control means in which the switch means is mounted for removal of said interruption in response to release of the operating energy after completion of said launching of the projectile, a housing removably inserted into the projectile and condition indicating window means mounted by the housing for visual exposure of the control means therethrough.

23. The system as defined in claim 22 wherein said control means include at least two different devices for respectively and independently detecting propulsion of the projectile during said launching thereof, interlocking means displaceable between active and inactive positions for respectively blocking and enabling said removal of the interruption in the ignition path by the control means and means responsive to detection of said propulsion of the projectile by both of the two detecting devices for enabling displacement of the interlocking means to the inactive position.

24. The system as defined in claim 23 wherein said window means visually exposes the interlocking means in the active position thereof and one of the two detecting devices in the inactive position of the interlocking means.

25. The system as defined in claim 24 wherein said projectile further includes a propelling motor while said two detecting devices respectively sense motor pressure and projectile acceleration.

26. The system as defined in claim 25 wherein said one of the two different devices of the control means include a slide displaceable to an arming position in which said switch means is actuated to remove the interruption in the ignition path and piston means displaceable in operative relation to the slider under said motor pressure for loading the storing means with the operating energy.

27. A safety system as defined in claim 26 wherein the other of the two detecting devices include acceleration responsive setback means for preventing said displacement of the slider to the arming position during said launching of the projectile.

28. A safety system adapted to be installed in a projectile having a detonator to which an ignition path is established, said system including switch means for maintaining an interruption in said ignition path during launching of the projectile, means for storing operating energy during the launching of the projectile, control means in which the switch means is mounted for removal of said interruption in response to release of the operating energy after completion of said launching of the projectile, said control means including at least two different devices for independently detecting propulsion of the projectile during said launching thereof, interlocking means displaceable between active and inactive positions for respectively blocking and enabling said removal of the interruption in the ignition path by the control means and means responsive to detection of said propulsion of the projectile by both of the two detecting devices for enabling displacement of the interlocking means to the inactive position.

29. The system as defined in claim 28 wherein one of the two detecting devices of said control means include a slider displaceable to an arming position in which said switch means is actuated to remove the interruption in the ignition path and piston means displaceable in operative relation to the slider for loading the storing means with the operation energy.

30. The system as defined in claim 29 wherein the other of the two detecting devices include acceleration responsive setback means for preventing said displacement of the slider to the arming position during said launching of the projectile.

31. A safety system adapted to be installed in a projectile having a detonator to which an ignition path is established, said system including switch means for maintaining an interruption in said ignition path during launching of the projectile, means for storing operating energy during said launching of the projectile, control means in which the switch means is mounted for removal of said interruption in response to release of the operating energy after completion of said launching of the projectile, said control means including a slider displaceable to an arming position in which the switch means is actuated to remove the interruption in the ignition path, piston means responsive to said launching of the projectile for displacement from a safe position to load the storing means with the operating energy and acceleration responsive means for delaying said displacement of the slider to the arming position by the operating energy from the storing means following said loading thereof by the piston means.

32. The system as defined in claim 31, further including a housing carried by the projectile within which the slider and the piston means are movably mounted and lock means mounted by the housing for rupture by said displacement of the piston means and the slider in sequence to releasably hold the piston means in said safe position and prevent said displacement of the slider to the arming position.

33. The system as defined in claim 32 wherein said lock means comprises a pair of shear wires respectively extending through bores in the housing into the piston means and the slider, said bores in the housing having openings through which the shear wires are visible prior to said rupture of the lock means.

* * * * *